United States Patent [19]

Vines

[11] 4,173,432

[45] Nov. 6, 1979

[54] VERTICAL WAVE AIR COMPRESSION DEVICE

[76] Inventor: Dorwin J. Vines, P.O. Box 71, South Prarie, Wash. 98385

[21] Appl. No.: 788,920

[22] Filed: Apr. 19, 1977

[51] Int. Cl.[2] ..... F04B 35/00; F04B 25/02

[52] U.S. Cl. ..... 417/231; 417/268; 417/333

[58] Field of Search ..... 417/229, 231, 331, 268, 417/333; 114/183 A, 185; 60/398, 497, 498, 501; 115/4

[56] References Cited

U.S. PATENT DOCUMENTS

| | | | |
|---|---|---|---|
| 1,520,853 | 12/1924 | Cable | 417/268 |
| 2,855,851 | 10/1958 | Shuman | 417/333 |
| 3,191,538 | 6/1965 | Adams | 417/333 X |
| 3,487,228 | 12/1969 | Kriegel | 417/331 X |

FOREIGN PATENT DOCUMENTS

| | | | |
|---|---|---|---|
| 97832 | 1/1940 | Sweden | 417/229 |

*Primary Examiner*—Carlton R. Croyle
*Assistant Examiner*—Richard E. Gluck
*Attorney, Agent, or Firm*—Kenneth S. Kessler

[57] ABSTRACT

Means for capturing the vertical energy of waves and transferring this energy to air compression is disclosed. A compression shell chamber is affixed to the hull of a boat. Housed within the compression shell chamber is a float whose size is equivalent to the inner dimensions of the compression shell chamber. When a swell moves the float vertically towards the top of the compression shell chamber, air is compressed and forced into a compressed air exhaust line.

The compressed air is utilized as it is forced into the compressed air exhaust feed line to a receptacle. The concept can be used to pump either water or air.

6 Claims, 4 Drawing Figures

VERTICAL WAVE AIR COMPRESSION DEVICE

BACKGROUND OF THE INVENTION

A travelling wave has two components of energy: a vertical component and a horizontal component. The device set forth herein utilizes the vertical component.

Several prior U.S. Patents have attempted to utilize the horizontal component of energy in waves. Two of the early patents Matthews U.S. Pat. Nos. 965,208 and Bates 1,039,081 used the horizontal component directly. In the Matthews Patent the wave surges up a tube and drives an air compressing piston. In the Bates Patent a large circular head confronts the wave directly, whereby the horizontal energy of the waves pushes the head and the air compressing piston forward.

U.S. Pat. Nos. 755,728 Weems and Tuch 1,267,936 use funnel-like mouths to collect the horizontal and vertical components of energy of incoming waves. In the Weems patent, a wave enters a funnel-like mouth, goes to the end of a tube and then forces a series of air compression pistons to move forward. In the Tuch Patent the wave is captured through the funnel-like mouth and pushes a piston forward compressing air. Unlike the disclosure set forth herein, the size of the piston is of one continous size, there is no large float which can add to the pressure exerted by the piston. Also, all of the patents which utilize horizontal components of wave energy must be constructed to withstand the strength of incoming waves pounding their structures. In the present structure, only the vertical component is used and the structure does not take the pounding that is found with those structures using the horizontal components of a wave.

In the Van Gils U.S. Pat. No. 3,271,959 the difference in hydrostatic pressure of a wave crest and wave trough is utilized to circulate water and run a turbine.

The present disclosure differs from the above patents in that the vertical swell component of a wave is used exclusively. A float in a compression chamber is used to compress the air.

SUMMARY OF THE INVENTION

One embodiment for capturing the vertical component of energy of swells and transferring this energy to air compression is set forth.

The first embodiment uses a compression shell chamber affixed to the hull of a bow of a boat. Housed within the compression shell chamber is a float whose size and configuration correspond to the inner dimensions of the compression shell chamber. Two exterior guide floats keep the elevation of the compression shell and the float housed therein at a maximum working position varying with the tides.

Extended from an opening in the top of the compression shell chamber is the compression cylinder. Extended from the float is a piston ram whose dimensions are constructed in order to fit within the compression cylinder. Thus, when a swell forces the float up vertically, the piston ram compresses the air in the compression cylinder, through an exhaust line, whereupon the compressed air's energy is utilized.

DETAILED DESCRIPTION OF THE DRAWINGS

The air compression chamber detailed herein is designed to capture the energy in the vertical component of the swells.

Figure 1:
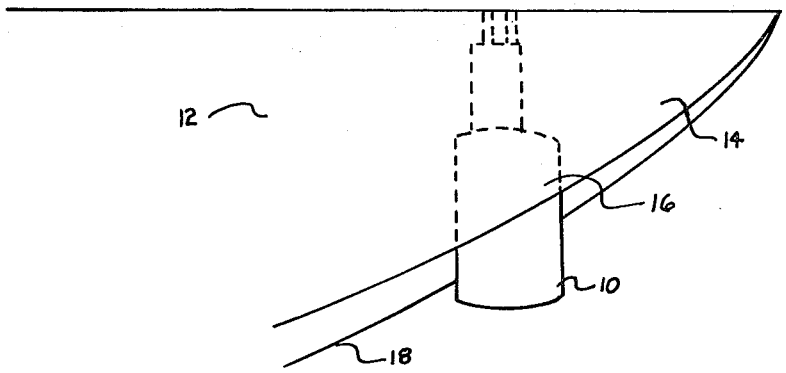
FIG. 1 is a side view of a hull of a boat illustrating the position of the air compression device in relation to the hull of the boat.

FIG. 1 illustrates the air compression chamber 10 affixed to the bow end 14 of boat 12. The compression chamber 10 is affixed to the hull 16 of the boat 12 near the keel 18. As the hull 16 approaches rising waves, the compression chamber 10 is allowed to interact with the incoming waves.

Although in the preferred embodiment the compression chamber 10 is affixed to the hull of a boat, the compression chamber 10 can be mounted on pilings, ship side, ocean and drilling derricks, or placed in other positions which have constant contact with the rise and fall of waves.

Figure 2:
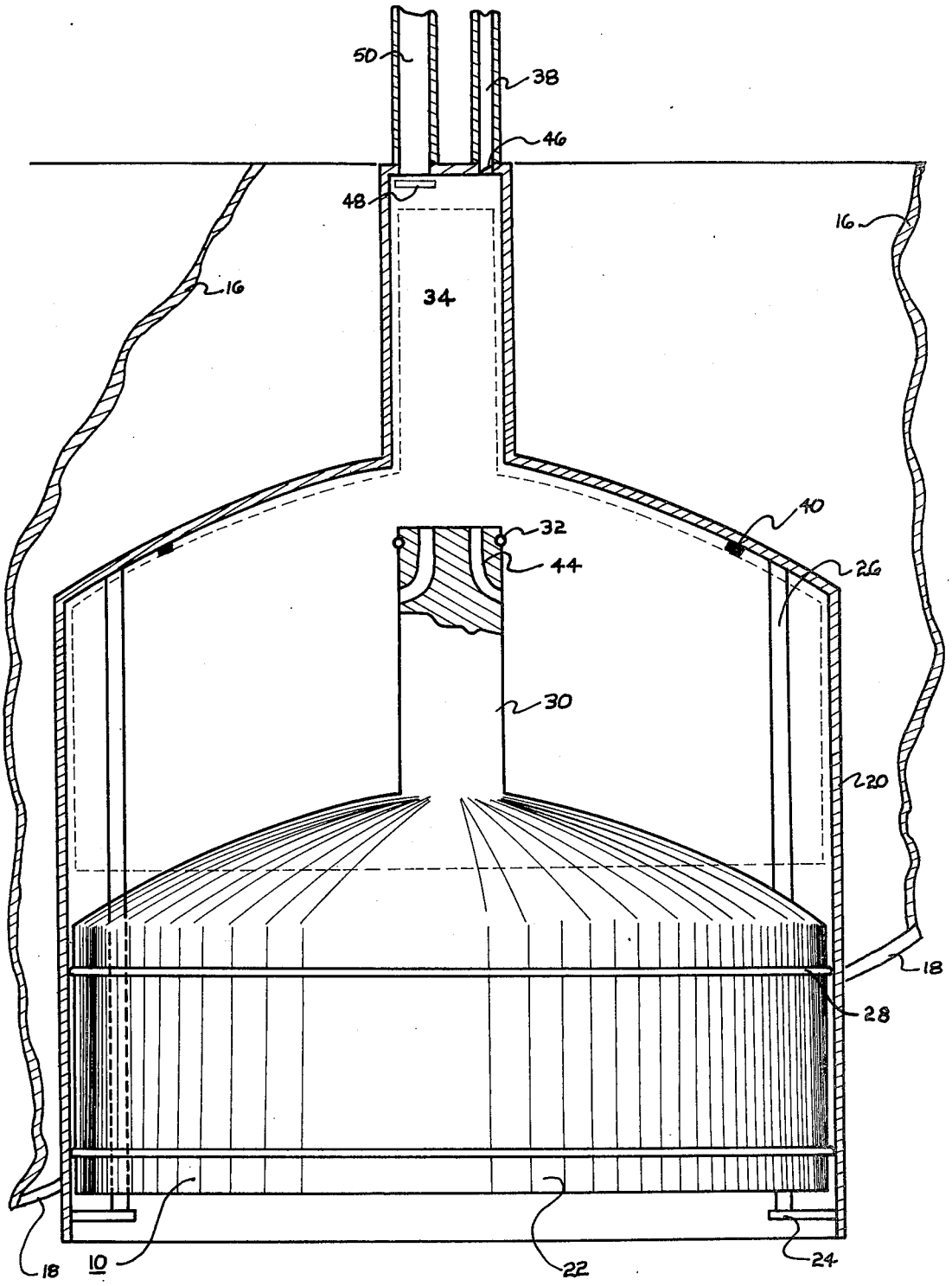
FIG. 2 is a side view of the compression shell chamber with a cutaway portion of the boat and a cutaway portion of the compression shell thereby showing the filler float. The piston portion of the filler float is also cutaway to show the air equalizing tubes.

FIG. 2 illustrates the compression chamber 10 by cutting away the hull 16 in its preferred embodiment with the compression shell 20 also cutaway thereby illustrating the float 22 directly. The float 22 must be constructed of a material which has a high degree of floatation and is also sufficiently strong to withstand the pressures of the action of the swells.

The contours of the float 22 are the same as compression shell 20 but the exact dimensions are such that the float 22 fits easily within the compression shell 20.

Affixed at the bottom of the compression shell 20 are float stops 24 which prevent the float 22 from leaving the compression chamber 10. In FIG. 2 guide rods 26 rise from the float stops 24 to the roof of the compression shell 20. The guide rods 26 aid in the rise and fall of the float 22. However, the guides 26 are not absolutely needed, for the float guide rings 28 may slide against the compression shell directly.

Rising from the top of the float 22 is the piston ram 30. Circumferencing the piston ram 30 is the piston ram ring 32 which aids in guiding of the piston ram 30 within the cylinder compression chamber 34.

In FIG. 2 the filler float 22 is resting at float stops 24. When a swell develops the float 22 is lifted to a position illustrated by the dotted lines. As the float 22 rises, the piston ram 30 compresses the air in the cylinder compression chamber 34, forcing the compressed air out the compressed air pipe 38. When the float reaches the top of the compression chamber, the float is cushioned by top cushion stops 40. Also, as the piston ram 30 reaches the roof of the cylinder chamber 42, the pressure is vented down air vent tubes 44 thereby roughly equalizing the pressure between the piston and the float, excluding the need for venting the space between the float 22 and compression shell 20.

As the wave raises the float 22, the compressed air valve 46 allows the compressed air to escape while the air intake valve 48 prevents air from escaping out the air intake pipe 50.

After the wave begins to recede, the float 22 recedes. This concludes the forcing of compressed air out the compressed air pipe 38, and the compressed air valve 46 closes preventing air from flowing through the compressed air pipe 38 back into the compression cylinder 34. However, upon the receding of the piston ram 30, the air intake valve 48 opens thereby allowing air to flow through the air intake pipe into the air compression cylinder 34. The flow of air and the consequent pressure in conjunction with gravity against a vacuum forces the float to recede.

As illustrated in FIGS. 1 and 2 a constant supply of compressed air is created by the vertical rising and falling of the float 22.

Figure 3:
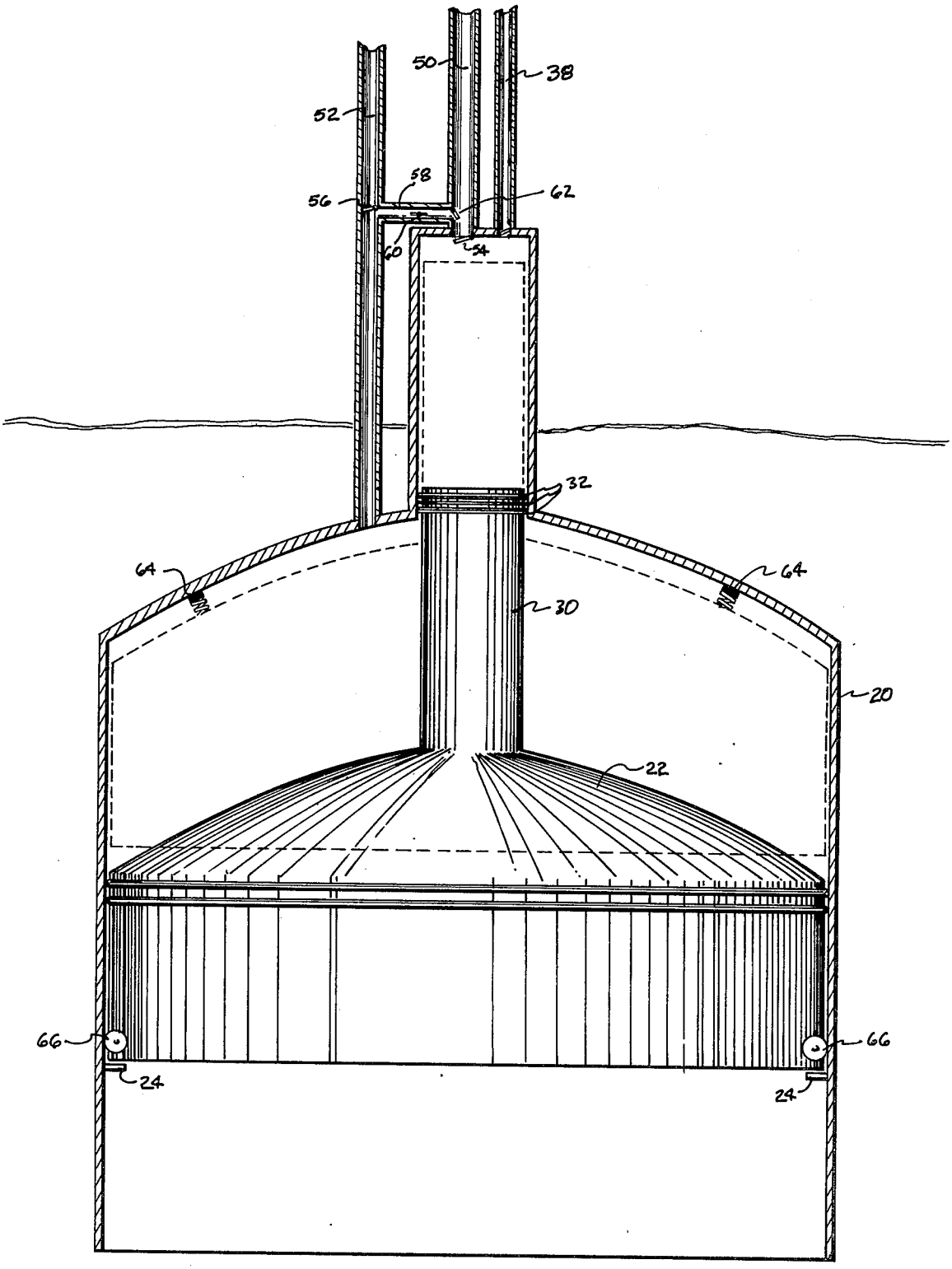
FIG. 3 is a side cutaway view of the compression shell chamber only with an additional intake pipe.

FIG. 3 merely illustrates a refinement of the basic design. The hull 16 of the boat 12 is not shown. The compression shell 10 is in the same position as the compression shell 10 in FIG. 2. An additional air intake pipe 52 is added so that air will be vented to the falling float 22 to aid its receding.

When a swell lifts the float 22 vertically, air intake valve 54 and valve 56 in addition to air intake pipe 52 are shut. Valve 62 opens in cross vent pipe 58 allowing air between the float and compression shell to enter the air intake pipe 50 on a lifting swell. The valve 60 in cross vent pipe 58 is manually operated and may be used to reinforce the other valves. In addition, valve 60 is shut when pumping water or oil.

On a receding wave, valves 56 and 54 open, thereby allowing air to enter the space between the compression shell 20 and float 22 aiding in the receding of the float 22.

Further modifications in FIG. 3 are seen in spring stop cushion 64 and modified stops 66 which meet float stops 24. In addition more than one piston ram ring 32 is attached to the piston ram 30.

Figure 4:
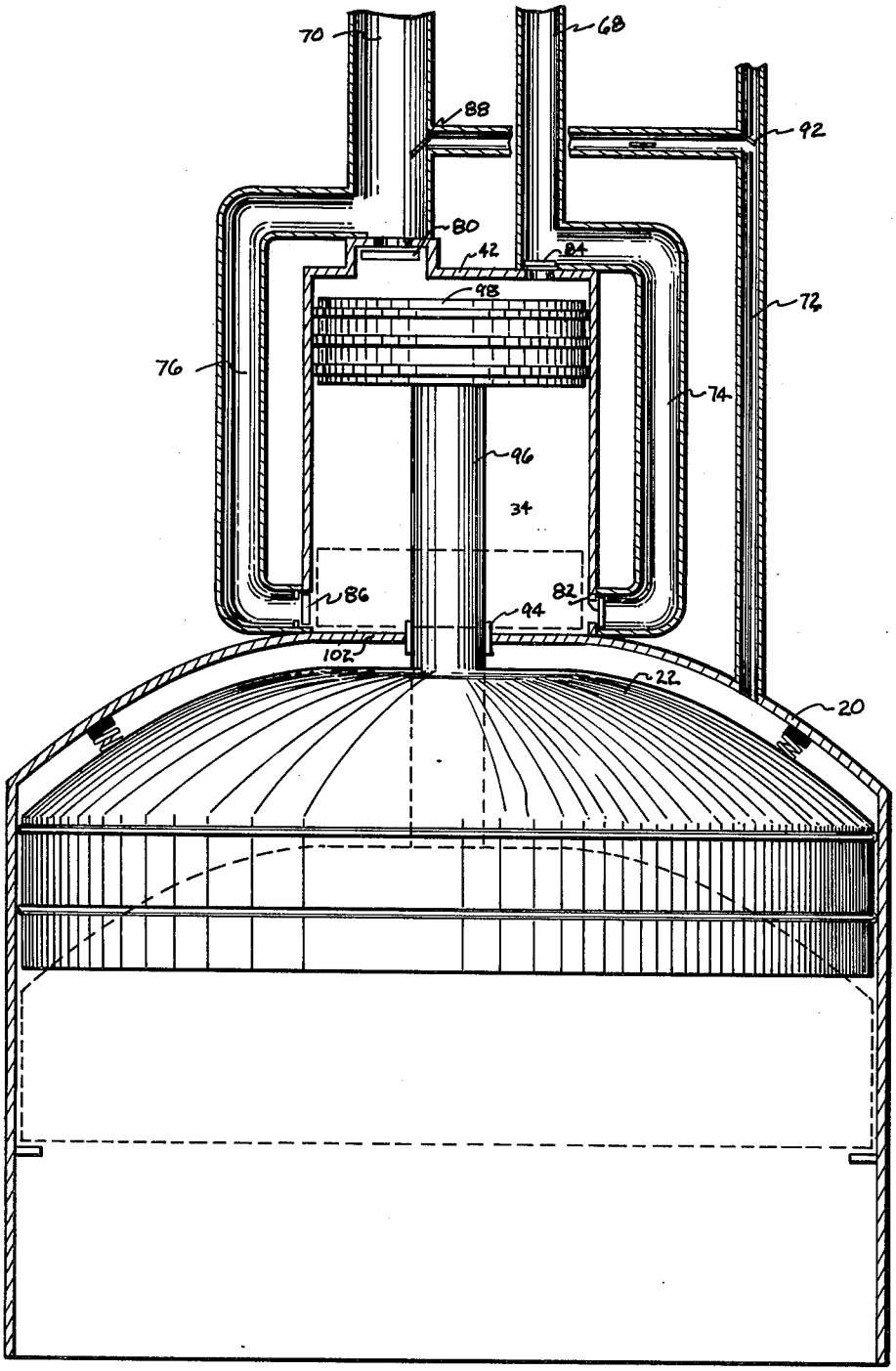
FIG. 4 is a side cutaway view of the compression shell chamber only wherein a double action two stage device is used.

FIG. 4 illustrates a further refinement of the basic concept wherein the air is compressed both on the rise and the fall of the swell. As in FIG. 3, the hull 16 of the boat 12 is not shown. The compression shell 10 is in the same position as the compression shell 10 in FIG. 2.

The piston ram 30 is replaced by piston head 98 and piston shaft 96. In order to prevent air from escaping into the cylinder compression chamber 34 from the space between the compression shell chamber 20 and filler float 22, piston shaft bushing and seal 94 is secured about piston shaft 96. Thus, when the wave reaches its apex, the piston head 98 is near the cylinder compression chamber roof 42 leaving a large unfilled space towards the bottom of the compression chamber.

When the swell is rising, compressed air is pushed through air exhaust pipe 68 through open exhaust air valve 84. In addition, air passes out vent pipe 72 and through valve 88 into air intake pipe 70. Valve 92 is closed preventing the escape of air through vent pipe 72.

On the rising wave, intake valve 86 is allowed to open. Thus, when the piston head 98 reaches near the cylinder chamber roof 42, air is found filling the void below the piston head 98 and between compression cylinder floor 102.

When the swell recedes, air intake valve 80 opens and air flows through air intake pipe 70 exerting a downward force on piston head 98. The air intake extension pipe 76 which opens at the bottom of the cylinder compression chamber 34, has its air intake valve 86 closed. However, air exhaust valve 82 opens and allows air forced down by the piston head 98 to escape out the exhaust extension pip3 74 and consequently out exhaust pipe 68 towards its use.

When the swell recedes, vent valve 92 opens allowing intake air to flow down vent pipe 72 to the space between the float 22 and compression shell 20. Vent valve 88 is closed on the receding swell.

Although the particular preferred embodiment of the invention has been disclosed for illustrative purposes it will be understood that variations or modifications thereof which lie within the scope of the appended claims are contemplated.

I claim:

1. A pump using the vertical energy of waves comprising:

a compression shell;

a float housed within the compression shell and sealingly engaging the walls thereof;

a compression cylinder arising from atop the compression shell with the inner area of the compression cylinder congruent to a hole in the top of the compression shell;

a piston ram attached to the float so that the piston ram will be housed within the compression cylinder on the rise and fall of the float;

inlet and discharge lines extending from the top of the compression cylinder;

a means for opening the discharge line on the rise of the piston ram and closing the discharge line on the falling of the piston ram;

a means for closing the inlet line on the rising of the piston ram and opening the lines upon the fall of the piston ram; a third line extending into the compression shell, a fourth line extending from said third line into said inlet line;

means for opening the third line from a source of fluid to the compression shell upon the fall of the float, means for closing the third line from the source of fluid to the compression shell upon the rise of the float;

means for opening the fourth line upon the rise of the float, means for closing the fourth line upon the fall of the float;

a means of attaching the compression shell to the bow of a boat.

2. The device as set forth in claim 1 wherein the float housed within the compression shell has a ring around the circumference of the float which lightly contacts the inner circumference of the compression shell.

3. The device as set forth in claim 1 wherein the means for closing and opening the lines comprise valves.

4. A pump using the vertical energy of both the rise and fall of waves comprising:

a compression shell;

a float housed within the compression shell and sealingly engaging the walls thereof;

a compression cylinder arising from atop the compression shell with the inner area of the compression cylinder congruent to a hole in the top of the compression shell;

a piston shaft attached to the float so that it would be in the center of the compression cylinder on the rise and fall of the float;

a piston head attached to the piston shaft whereby the piston head will be housed within the compression cylinder on the rise and fall of the float;

a bushing and seal about the piston shaft preventing the flow of air between the compression cylinder and the compression shell;

an exhaust line extending from the top of the compression cylinder;

an air intake line extending from the top of the compression cylinder;

a means for closing the air intake line on the rise of the piston head and opening the line on the fall of the piston head;

an air intake extension line opening at one end at the bottom of the compression cylinder and opening on the other end at the air intake line;

a means for opening the opening of the air intake extension line to the bottom of the compression cylinder upon the rise of the piston head and closing the line upon the fall of the piston head;

an air exhaust extension line opening at one end at the bottom of the compression cylinder and opening on the other end at the exhaust line;

a means for opening the opening of the exhaust extension line to the bottom of the compression cylinder upon the fall of the piston head and closing the line upon the rise of the piston head; an additional air intake line extending into the compression shell, a cross vent line extending from said additional air intake line into said air intake line;

means for opening the additional air intake line from a source of air to the compression shell upon the fall of the float, means for closing the additional air intake line from the source of air to the compression shell upon the rise of the float;

means for opening the cross vent line upon the rise of the float, means for closing the cross vent line upon the fall of the float; and a means of attaching the compression shell to the bow of a boat.

5. The device as set forth in claim 4 wherein the float housed within the compression shell has a ring around the circumference of the float which lightly contacts the inner circumference of the compression shell.

6. The device as set forth in claim 4 wherein the means for closing and opening the lines comprise valves.

* * * * *